United States Patent [19]

Vest

[11] 4,352,539

[45] Oct. 5, 1982

[54] FLUORESCENT LIGHT WITH THREADED CONNECTOR

[76] Inventor: Gary W. Vest, 4480 Broadview Rd., Cleveland, Ohio 44109

[21] Appl. No.: 154,790

[22] Filed: May 30, 1980

[51] Int. Cl.[3] ..... F21V 23/02

[52] U.S. Cl. ..... 339/154 L; 362/221

[58] Field of Search ..... 339/50 R, 154 L, 155 L; 362/217, 221, 222, 226

[56] References Cited

U.S. PATENT DOCUMENTS

| | | | |
|---|---|---|---|
| 2,489,686 | 11/1949 | Suter | 362/221 |
| 2,874,270 | 2/1959 | Douglass et al. | 362/222 |
| 3,815,080 | 6/1974 | Summa | 362/217 |
| 3,953,761 | 4/1976 | Giudice | 362/221 |

*Primary Examiner*—Eugene F. Desmond

*Attorney, Agent, or Firm*—Pearne, Gordon, Sessions, McCoy & Granger

[57] ABSTRACT

A portable fluorescent light, utilizing a fluorescent tube mounted in an elongated, transparent, plastic housing. Sockets for the fluorescent lamp are mounted to the interior of the housing and electrical circuitry within the housing supplies current to operate the lamp. The circuitry includes a ballast and a starter that are also mounted within the tubular housing at one end. A threaded lamp connector of the type normally found on incandescent light bulbs extends outwardly from one end of the housing and is associated with the electrical circuitry to provide an electrical connector for connecting the light to a conventional alternating current power source. The threaded connector is adapted to be threaded into a standard threaded female socket, such as might be found at the end of an incandescent-trouble-light cord unit.

1 Claim, 4 Drawing Figures

FLUORESCENT LIGHT WITH THREADED CONNECTOR

BACKGROUND OF THE INVENTION

This invention relates to portable lights, such as safety inspection lights or "trouble" lights, and especially to the type of portable light that utilizes a fluorescent lamp rather than an incandescent bulb. More particularly, the invention relates to an improvement in portable fluorescent light units to adapt such units for use in association with separate power cords with threaded female sockets on one end.

Portable fluorescent lights have many advantages compared with other types of "trouble" lights, etc., and they are used to particular advantage in garages where automotive service is performed, as well as in otherwise unlighted areas, such as attics, that are used infrequently. Prior art units of this type generally utilize a tubular, transparent, plastic housing of fairly sturdy construction and a fluorescent lamp, such as a 15-watt, 17-inch lamp mounted thereon. The electrical circuit elements, including sockets and a starter, are also mounted in the housing. A ballast is provided, usually on a power cord.

Most such portable lights in the prior art have had an integral power cord that is sufficiently long to enable light to be carried around a relatively large area. In many circumstances, this is desirable; however, in other circumstances, it is desirable to have a power cord for the light that also serves as an extension cord for a portable power tool that is to be used in an otherwise inaccessible area in which the light is to be used to illuminate.

Also, prior art portable lights of the type described, with integral power cords, cannot be connected to standard threaded incandescent light bulb receptacles unless special adapters are used.

The portable fluorescent light design of the present invention, however, avoids the difficulties indicated above and affords other features and advantages heretofore not obtainable.

SUMMARY OF THE INVENTION

It is among the objects of the invention to provide a portable fluorescent light with self-contained starter and ballast that may be connected to a power source by means of a threaded female connector of the type found on standard incandescent light bulbs.

Another object of the invention is to provide a trouble light construction that does not include a self-contained power cord, but which may be connected directly to the threaded socket at the end of a power cord for a standard incandescent trouble light unit.

These and other objects and advantages are achieved by the novel portable fluorescent light construction of the invention wherein the unit is provided with a fluorescent lamp and sockets and electrical circuit means including a switch for connecting the unit to a power source. The fluorescent lamp and associated electrical circuit elements are mounted in an elongated, transparent, tubular housing to which the lamp sockets are firmly mounted. The circuitry includes a ballast and starter mounted within the housing and a threaded male electrical connector located externally of the light and at one end thereof. The threaded male connector is supported by the ballast and electrically connected in the circuitry so that when the threaded connector is threaded into a conventional incandescent light bulb socket, it may be used to energize the fluorescent lamp.

DESCRIPTION OF THE PREFERRED EMBODIMENT

Figure 1:
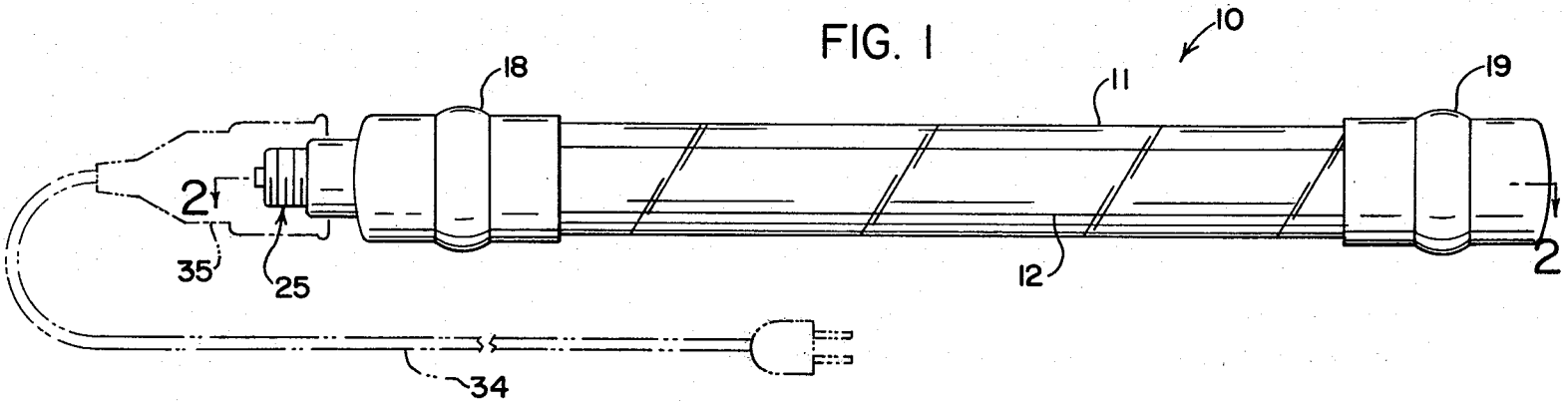
FIG. 1 is an elevational view illustrating a portable fluorescent light constructed in accordance with the invention.

Referring more particularly to the drawings, there is shown a portable fluorescent light 10 embodying the invention, and comprising a transparent tubular housing 11, a fluorescent lamp (for example, of 17-inch length) located in the tubular housing 11, two sockets 13 and 14 to which the ends of the fluorescent lamp 12 are connected in a conventional manner, a ballast 16, and a starter 17. A pair of plastic covers 18 and 19 are placed over each end of the housing 11, the cover 18 having a central opening therein coaxial with the housing 11 and adapted for the purpose to be described below.

The sockets 13 and 14 are mounted within the housing 11 by means of screws 21 and 22, two of which are extended in diametrically opposed relationship through the housing and into each of the sockets 13 and 14, respectively.

Figure 2:
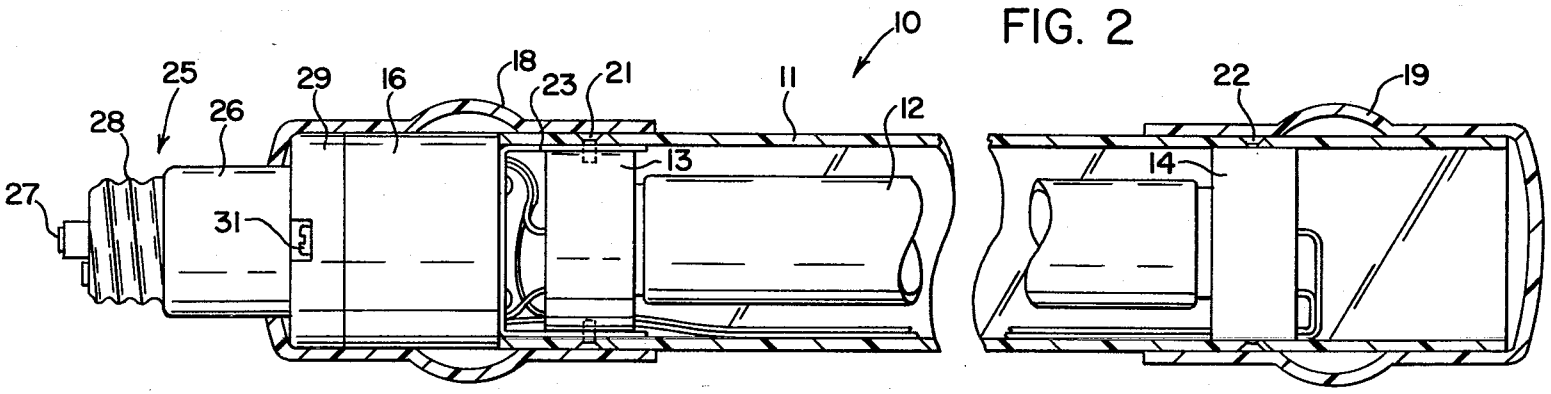
FIG. 2 is a broken sectional view on an enlarged scale, taken on the line 2—2 of FIG. 1.
Figure 3:
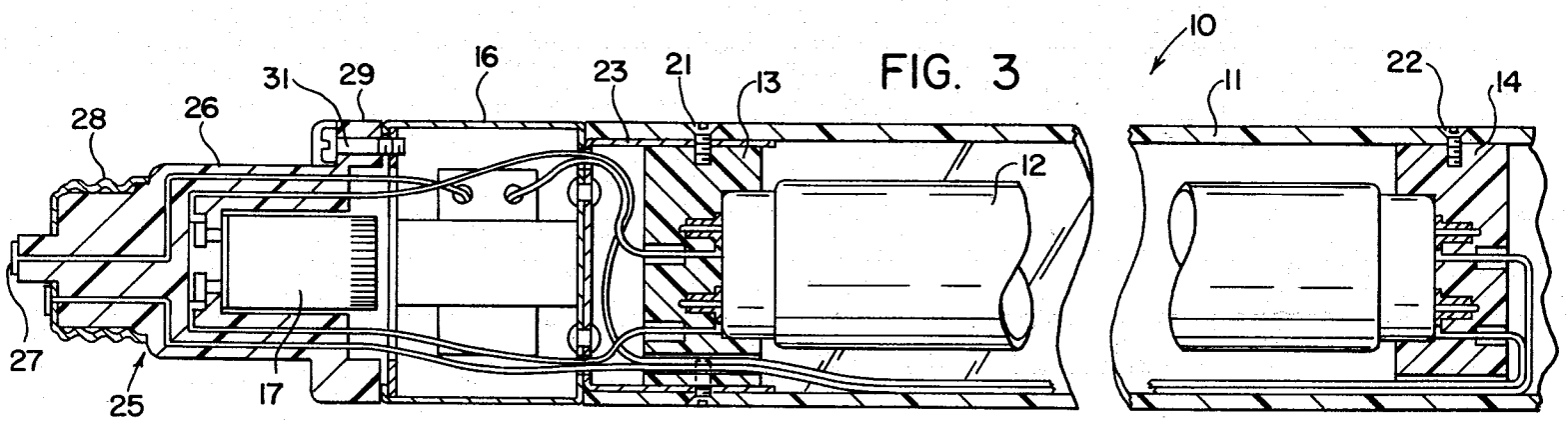
FIG. 3 is a broken sectional view similar to FIG. 2 but with additional parts broken away for the purpose of illustration.
Figure 4:
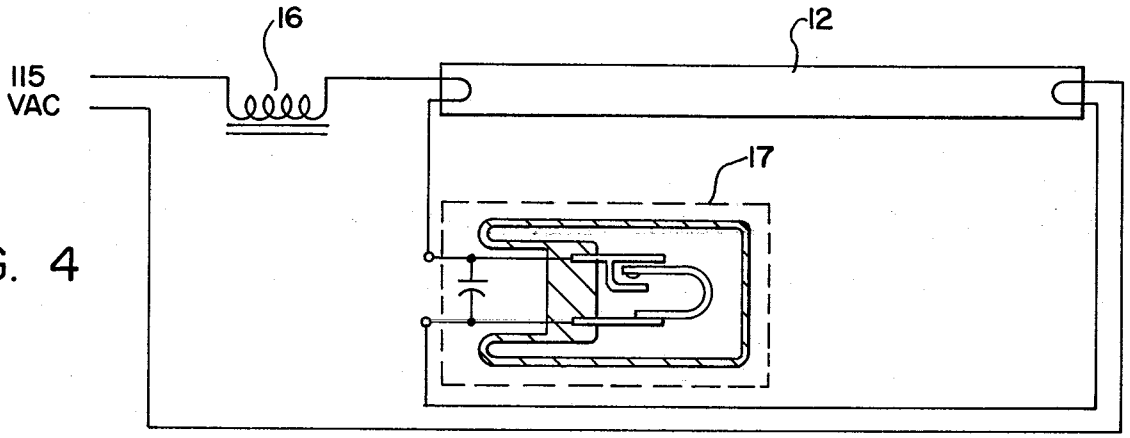
FIG. 4 is a schematic diagram of the electrical circuitry for the portable fluorescent light of the invention.

The ballast 16 is located on the housing 11 at the lefthand end thereof as viewed in FIG. 2 and is affixed by rivets to a bracket 23, which in turn is secured to the housing 11 by screws 24. The ballast and sockets 13 are all electrically connected by appropriate conductors to provide circuitry that serves to energize the lamp 12.

In order to connect the portable fluorescent light 10 to a power source, there is provided at the lefthand end thereof, adjacent the ballast 16 as viewed in FIG. 2, a threaded connector 25 of the type normally utilized on conventional incandescent light bulbs for connecting the bulb to a conventional threaded female socket. The connector 25 is of a conventional, commercially available construction and includes a housing 26 formed of electrical insulating material, a central contact 27, and an annular contact part 28 with external threads formed therein and being attached to the forward portion of the housing 26. The rearward portion of the housing 26 has a cylindrical recess formed therein in which the starter unit 17 is positioned. A pair of radially extending arm portions 29 have openings that receive screws 31 for attaching the connector 25 to the ballast 16. It will be noted that the heavy ballast 16 is located close to the connector 25 so as to minimize cantilever type loading at the threaded connection.

The most advantageous utilization of a lamp constructed as described above is in association with a conventional trouble light power cord 34 and receptacle 35, as shown in dashed lines in FIG. 1. The receptacle 35 normally includes a threaded female socket adapted to receive an incandescent bulb. In the present case, the threaded connector 25 is merely threaded into the threaded female socket in the receptacle 35 of the power cord, which also serves as an extension cord for the user. Accordingly, the fluorescent light may be substituted for an incandescent light, which presents certain disadvantages and is more easily broken. It is particularly advantageous to use the arrangement of the trouble light of the invention in automotive applications where, should an incandescent bulb break, inflammable material might be ignited, resulting in an explosion, etc.

While the invention has been shown and described with respect to a specific embodiment thereof, this is for the purpose of illustration rather than limitation, and it will be apparent to those skilled in the art that other variations and modifications of the specific form herein shown and described may be used without departing from the spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In a portable fluorescent light including an elongated, transparent, tubular housing, an axially elongated, cylindrical fluorescent lamp positioned in said housing coaxial therewith, and electrical circuit means, including two fluorescent lamp sockets, for energizing said lamp, each one of said lamp sockets being mounted on said tubular housing adjacent an associated end thereof, the improvement wherein the lamp further comprises:

electrical ballast means associated with said electrical circuit means and including a protective cover therefor, said cover being connected to and in axial alignment with said housing;

electrical lamp starter means associated with said electrical circuit means; and connector means at the end of the light associated with said ballast means and in axial alignment with said cover, said connector means including at its end distal from said housing a threaded annular electrical contact adapted for electrical connection to a conventional threaded electrical socket of a trouble light power cord for energizing said fluorescent lamp, said connector means including a generally cylindrical dielectric body with a recess formed therein to receive said starter means, said cylindrical dielectric body and starter means therein being adapted to be received within the incandescent bulb receptacle of the trouble light power cord while the ballast is disposed axially between the start and the fluorescent lamp and is thereby adapted to be supported out of but adjacent the receptacle of the power cord when the electrical contact is fully engaged with the electrical socket of the trouble light power cord.

* * * * *